US005350127A

United States Patent [19]

Arnold et al.

[11] Patent Number: 5,350,127

[45] Date of Patent: Sep. 27, 1994

[54] PROCESS AND DEVICE FOR MONITORING THE BOBBIN THREAD ON STITCH-FORMING MACHINES

[75] Inventors: Kurt Arnold, Kaiserslautern; Wolfgang Hauck, Weilerbach; Reiner Klein, Kaiserslautern; Bernhard Mertel, Enkenbach-Alsenborn; Karl-Heinz Walther, Weilerbach; Horst Zinssmeister, Kaiserslautern, all of Fed. Rep. of Germany

[73] Assignee: G.M. Aktiengesellschaft, Kaiserlauter, Fed. Rep. of Germany

[21] Appl. No.: 58,470

[22] Filed: May 6, 1993

Related U.S. Application Data

[62] Division of Ser. No. 886,957, May 21, 1992.

[30] Foreign Application Priority Data

May 23, 1991 [DE] Fed. Rep. of Germany ..... 4116788

[51] Int. Cl.[5] ..... B65H 54/02

[52] U.S. Cl. ..... 242/20; 242/22; 242/36; 242/47; 112/279

[58] Field of Search ..... 112/279, 220, 273, 278, 112/271, 186, 181; 242/20, 22, 23, 18 R, 36, 49, 21, 24, 47, 174, 176, 159

[56] References Cited

U.S. PATENT DOCUMENTS

| | | | |
|---|---|---|---|
| 4,216,733 | 8/1980 | Kornatowski | 112/279 X |
| 4,259,914 | 4/1981 | Johnson | 112/279 X |
| 5,211,121 | 5/1993 | Sakakibara | 242/47 X |

*Primary Examiner*—Peter Nerbun
*Attorney, Agent, or Firm*—McGlew and Tuttle

[57] ABSTRACT

A process and device for monitoring the bobbin thread on stitch-forming machines, on the bobbin of which a residual amount of thread is wound in a winding direction opposite the direction of winding of the principal amount of thread, is to ensure that a first control function will be generated at the beginning of consumption of the residual amount of thread, and a second control function is generated nearly without delay in the case of thread end or thread break. To achieve this, two signal patterns are received with a phase shift from a bobbin acting as a signal generator, and the first signal function is generated in the case of a deviation of the actual phase shift from the desired phase shift. If only one signal pattern is received, this first control function is also generated if its signal sequence deviates from a reference signal sequence. The second control function is generated if a stoppage of the bobbin lasts longer than a predeterminable number of stitches. Devices for carrying out this process, as well as a device for winding thread on the bobbin in different directions of rotation for the principal amount of thread and the residual amount of thread are provided.

4 Claims, 6 Drawing Sheets

| | X1 | X2 |
|---|---|---|
| W1 | L | H |
| W2 | L | L |
| W3 | H | L |
| W4 | H | H |
| W5 | L | H |
| . | . | . |
| . | . | . |
| . | . | . |
| . | . | . |
| . | . | . |
| . | . | . |

| | X1 | X2 |
|---|---|---|
| W1 | L | H |
| W2 | L | L |
| W3 | H | L |
| WD1 | L | L |
| WD2 | L | H |
| WD3 | H | H |
| . | . | . |
| . | . | . |
| . | . | . |

PROCESS AND DEVICE FOR MONITORING THE BOBBIN THREAD ON STITCH-FORMING MACHINES

This is a divisional application of application Ser. No. 07/886,957 filed May 21, 1992.

FIELD OF THE INVENTION

The present invention pertains to a process for monitoring thread on a stitch-forming machine, e.g., sewing machines with a shuttle (looper or hook), on a bobbin of which the thread turns of a predeterminable residual amount of thread are wound in a direction opposite the direction of winding of the principle amount of thread such that upon the residual amount of thread being pulled off, the direction of rotation of the bobbin reverses to a direction which is opposite the direction of rotation of a principle amount of thread, the reversal of direction being detected and triggering a control function. The invention also relates to a device for monitoring the bobbin thread and actuating an indicator or a motor shut-off switch and also relates to a device for winding up thread on a bobbin including a residual amount in an opposite direction from the principle amount of thread.

A reserve monitor for monitoring the thread reserve of a bobbin, on which a residual amount of thread is accommodated in a direction of winding opposite to that of the principal amount of thread to achieve a change in the direction of rotation during unwinding the bobbin thread, has been known from U.S. Pat. No. 1,625,231. As long as the bobbin maintains its direction of rotation that is associated with the principal amount of thread, an ejection mechanism, which is put into operation at the end of each sewing process, is ineffective for the bobbin. However, as soon as the bobbin rotates in the opposite direction at the beginning of the consumption of the residual amount of thread, the ejection mechanism is able to assume its function.

Since the ejection mechanism is put into operation only at the end of a sewing process, a control function, which is initiated by the change in the direction of rotation of the bobbin, does not take place immediately at the time of the change in the direction of rotation, but it may take place much later, especially in the case of greater seam lengths, possibly only after the residual amount of thread had been completely consumed. Consequently, the safety of reserve monitoring offered by this reserve monitor is insufficient, and other disturbances, e.g., thread break, are not detected at all.

German Patent No. DE 35,40,126 A1 discloses a device called an integrated thread monitor and process monitor system, in which the direction of rotation of a bobbin is monitored by two sensors, both of which are directed toward a bobbin flange provided with light and dark fields and are arranged next to each other at a distance corresponding to half of one field.

The sensors are intended only to monitor the direction of rotation of the bobbin during the unwinding process to check whether the bobbin is inserted in the correct position. No provisions are made for more extensive utilization of the direction of rotation here.

U.S. Pat. No. 5,018,465 discloses a thread monitor for the bobbin thread, whose sensor, which receives signals during the rotation of the bobbin, is connected to a stitch counter. The stitch counter is reset to an initial value by each signal, and consequently reaches a predeterminable end value only when the resetting process fails to take place when no further signal is received as a consequence of stoppage of the bobbin caused by thread break or thread end.

Since the thread monitor recognizes a thread disturbance from stoppage of the bobbin, the stitch formation process without accompanying stitch formation can be prevented from continuing, but, since monitoring of the thread reserve on the bobbin is not possible with this thread monitor, the thread end is recognized only when the bobbin thread has been nearly completely consumed. With such a small amount of thread, stitch formation can be continued only after an intermediate stop to replace the empty bobbin with a full one.

SUMMARY AND OBJECTS OF THE INVENTION

A primary object of the present invention is to provide a process for monitoring the bobbin thread on a stitch-forming machine, as well as a device for carrying out this process, with which a control function is issued at the beginning of consumption of a predeterminable residual amount of thread, and another control function is issued nearly without delay when the residual amount of thread drops below a predeterminable minimum or in the case of a thread break.

At two monitoring points, the signal pattern that is received during the pull-off of the principal amount of thread at the monitoring point that is the first monitoring point in the direction of rotation of the bobbin leads the other signal pattern by a phase shift that depends on the mutual distance between the two monitoring points. This phase shift is determined and compared with a preset phase shift set value. There is agreement between the two phase shifts as long as the bobbin maintains its direction of rotation.

A change in the direction of rotation of the bobbin causes the first signal pattern, which hitherto was the leading signal, to follow the second signal. Since the new phase shift resulting from this differs from the phase shift set value, the change in the direction of rotation of the bobbin and the beginning of the consumption of the residual amount of thread, which is associated with this change, can be recognized from this difference.

If only one monitoring point is provided, the signals of the signal pattern received are analyzed with respect to at least one characteristic feature of the signal, such as the signal duration or the signal intensity, in order to obtain the sequence of the signals, hereinafter called signal sequence for short, from the sequence of the different signal characteristics. By comparing this signal sequence with that of a predeterminable signal pattern set value, it can be determined whether there is an agreement. As long as there is an agreement, the principal amount of thread is being consumed, and the bobbin is rotating in the initial direction of rotation. However, when a signal sequence that is a mirror image of that of the signal pattern set value is received, a change in the direction of rotation of the bobbin is recognized from the lack of agreement of the signal sequence. For a particularly reliable monitoring of this change in the direction of rotation, it is recommended to check the signal sequence received not only for agreement with the signal sequence of the signal pattern set value, but also for agreement with a signal sequence that is its mirror image.

To monitor the bobbin thread for break, it is sufficient to evaluate a single signal pattern, whose signal frequency is an indicator of the speed of rotation of the bobbin and consequently the pull-off of the bobbin thread, and which is therefore present only as long as the bobbin thread is being pulled off from the bobbin correctly. Even though the signals also end in the case of a temporary interruption of the thread pull-off, e.g., because of slack thread, they reappear once the slack thread has been consumed. Since such a phenomenon does not impair the quality of the seam, a control function will be suppressed if the absence of signal changes is concluded before a predeterminable number of stitch formation cycles is reached. In contrast, in the case of a thread break, which continues as a permanent thread disturbance until the predeterminable number of stitch formation cycles is reached, the control function will come into action.

Since a plurality of different thread disturbances can be recognized with the process according to the present invention, a defined control function is associated with each thread disturbance, in order to initiate the most advantageous control function on the stitch-forming machine in the case of a certain thread disorder. For example, when a thread break has occurred, the sewing process is immediately terminated, whereas it is logical to prevent the sewing process from continuing only after completion of the seam actually being formed if the beginning of consumption of the residual amount of thread is recognized.

The phase shift between two signal patterns can be determined and compared with a phase shift set value wherein lack of agreement of the phase shift determined with the phase shift set value can be used for triggering the control function such as an indicator or a motor switching. The bobbin may also be provided with a specific pattern wherein the rotational direction of the bobbin determines the sequence of the pattern as read by a sensor by which the signal sequence in a signal pattern can be determined and compared with a signal sequence of a signal pattern set value.

The distance between the two monitoring points for analyzing phase shift is constant, at least during the sewing process, so that only the sign of the phase shift, but not its amount, will change in the case of a change in the direction of rotation of the bobbin. The comparison device can therefore be of a particularly simple design wherein the comparison is made in terms of the sign of the phase shift.

An advantageous embodiment of the comparison device is provided by which the comparison process for recognizing a difference between the phase shift and the phase shift set value does not have to be performed continuously, but can be performed during predeterminable phases of stitch formation. This leads to a considerable reduction of the expense of monitoring.

As a consequence of the drive-induced vibrations of the sewing machine, the bobbin may perform a forward-and-backward movement, especially when the thread tension is reduced, e.g., as a consequence of a slack thread. To rule out the possibility that this process, known as bobbin jitter, is interpreted as a change in the direction of rotation of the bobbin, the direction of rotation detector may be equipped with a bobbin jitter filter, by which the emission of a signal indicating the change in the direction of rotation can be suppressed as long as the direction of rotation detector detects, during a predeterminable number of stitch formation cycles, both rotation of the bobbin in the direction of rotation associated with the principal amount of thread and, alternating with this, a rotation in the opposite direction.

The variant of the invention including a thread break detector, which sends a control function upon the appearance of an interruption of at least one signal pattern continuing beyond a predeterminable number of stitch formation cycles and a rotation direction detector connected to a error decoder, by which a machine function associated with thread disturbance actually detected can be generated, makes it possible to associate a predeterminable control signal with each detectable thread disturbance in a particularly simple manner.

By designing the device with an auxiliary device which guarantees continuation of a seam after elimination of a disturbance with respect to the bobbin thread wherein the operation of the auxiliary device can be activated either by a control function of the thread break detector or by a second control function of a comparison device, following a first control function of the comparison device after a predeterminable number of stitch formation cycles (as is known from U.S. Pat. No. 5,078,068 for carrying out the process described there), it is ensured—if the control function which brings about immediate stopping of stitch formation is issued in the midst of a seam—that the fabric being sewn will be returned by such an amount that the insertion hole in which the last correct knotting of the needle thread with the bobbin thread took place will be located under the needle. After feeding in new bobbin thread, this will be knotted with the needle thread through at least one stitch formation cycle performed without fabric feed. The seam formation is subsequently continued with the same feed step in the direction of feed as before the thread disturbance.

Even though a bobbin on which tile direction of winding of the residual amount of thread is opposite that of the principal amount of thread is used in U.S. Pat. No. 1,625,231 mentioned ill the introduction, this patent makes no reference to a device with which such bobbin winding could be carried out.

Therefore, a further object of the present invention is to provide a device by which a predeterminable residual amount of thread can be wound on the bobbin in the direction opposite tile winding direction of the principal amount of thread.

According to the invention, a device for winding of thread on a bobbin is provided with a counting device for counting the revolutions of a bobbin winder shaft to obtain information regarding an amount of thread in different thread winding directions. The invention provides that a predeterminable filling ratio of the bobbin is determined based on a number of revolution of the bobbin winder shaft. This predeterminable filling ratio is reached based on reaching a set number of revolutions based on a counting device upon which the direction of rotation of the winder shaft is reversed. A deflecting member is provided for deflecting the direction of the thread. The deflecting member is moved by an adjusting means from a resting position, outside a path of feed of the thread, into a deflecting position, located within the path of feed of the thread.

By presetting a predeterminable bobbin filling ratio, preferably by presetting a number of revolutions of the bobbin winder shaft, the change in the direction of rotation of the bobbin winder shaft is initiated and the deflecting element is transferred from its resting position into its deflecting position as soon as a number of thread turns associated with the bobbin filling ratio has been wound on the bobbin. The predeterminable bobbin filling ratio is preferably monitored by a counting device which is provided with a sensor device that receives, on each revolution of the bobbin winder shaft, a predeterminable number of signals that can be generated either by the bobbin winder shaft itself or a marking provided on the bobbin. However, the filling ratio may also be displayed by a tracer that can be set depending on the required number of turns as well as the thread thickness.

In its deflecting position, the deflecting member forms a support for the last turn of thread wound up in the current direction of rotation, and the bobbin thread is pulled against this support when the bobbin winder shaft and consequently the bobbin are driven in the opposite direction of rotation. This prevents part of the thread turns of the residual amount of thread that are wound up last from being loosened or again pulled off from the bobbin as a consequence of the change in the direction of rotation. The deflecting member also causes the first thread turn wound up in the new direction of rotation to be wound up firmly.

The deflecting member may either remain in its deflecting position during the remainder of the winding process or, it can be retracted into its resting position after a predeterminable number of additional thread turns have been wound up.

The deflecting member can be moved in parallel to an axis of the bobbin and can be shifted into the bobbin through an opening provided in one of the bobbin flanges. This opening is preferably formed by a carrier slot present in the bobbin flange. In this way, the deflecting member enters, on its way into the deflecting position, the carrier slot, which is needed for the winding process and is therefore provided in each of the two flanges in commercially available bobbins.

A further objection of the invention is to provide a simple and trouble-free process and apparatus for detecting change over of bobbin thread from a primary winding direction to a residual (opposite) winding direction which is economical to manufacture and reliable in construction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
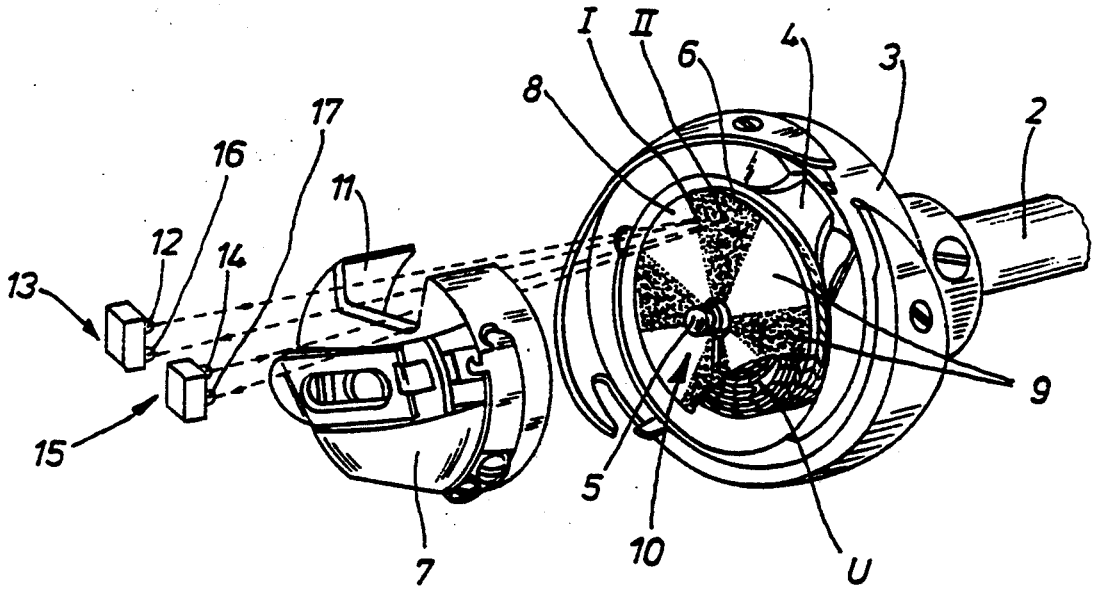
FIG. 1 is and exploded perspective view showing a shuttle (or looper or hook, depending on the type of the sewing machine) accommodating a bobbin in a sewing machine with sensor devices also shown schematically.
Figure 3A:
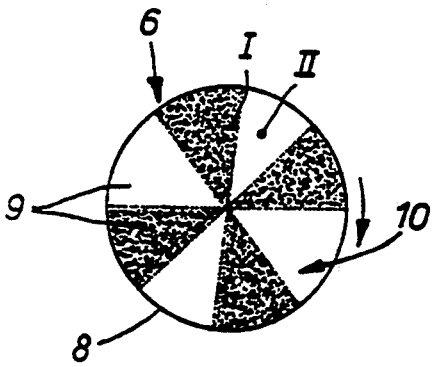
FIG. 3 is a view showing points on the bobbin monitored by the sensor devices in different rotation positions of the bobbin.
Figure 3B:
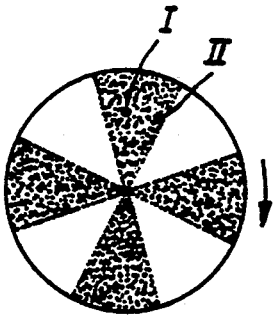
Figure 3C:
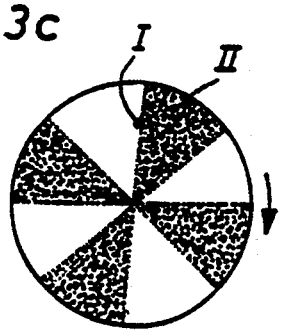
Figure 3D:
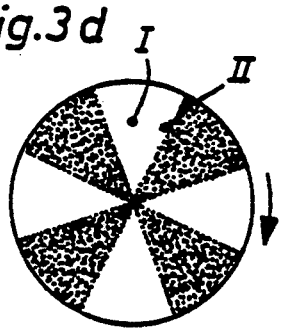

The shuttle drive of a first exemplary embodiment shown in FIG. 1 contains a shuttle (or looper/hook) drive shaft 2, which is in drive connection with the main shaft 1 (FIG. 2) of a sewing machine in a manner not shown, and on which a shuttle (looper/hook) body 3 is nonrotatably attached. The shuttle body 3 accommodates a lower bobbin case 4, which has a central pin 5 for accommodating a bobbin 6, on which a residual amount of bobbin thread is accommodated, as is shown at point U, in a winding direction that is opposite the winding direction of the principal amount of thread.

The bobbin 6 is provided on the outside of its flange 8 facing the upper bobbin case 7 with a marking 10 formed by light-and-dark fields 9.

The upper bobbin case 7 is provided with an opening 11 for the entry and exit of light beams. These are emitted by a photodiode 12 of a first sensor device 13 as well as a photodiode 14 of a second sensor device 15 and are sent, after being reflected from the marking 10, to a photodetector 16 of the first sensor device 13 as well as to a photodetector 17 of the second sensor device 15.

Figure 2:
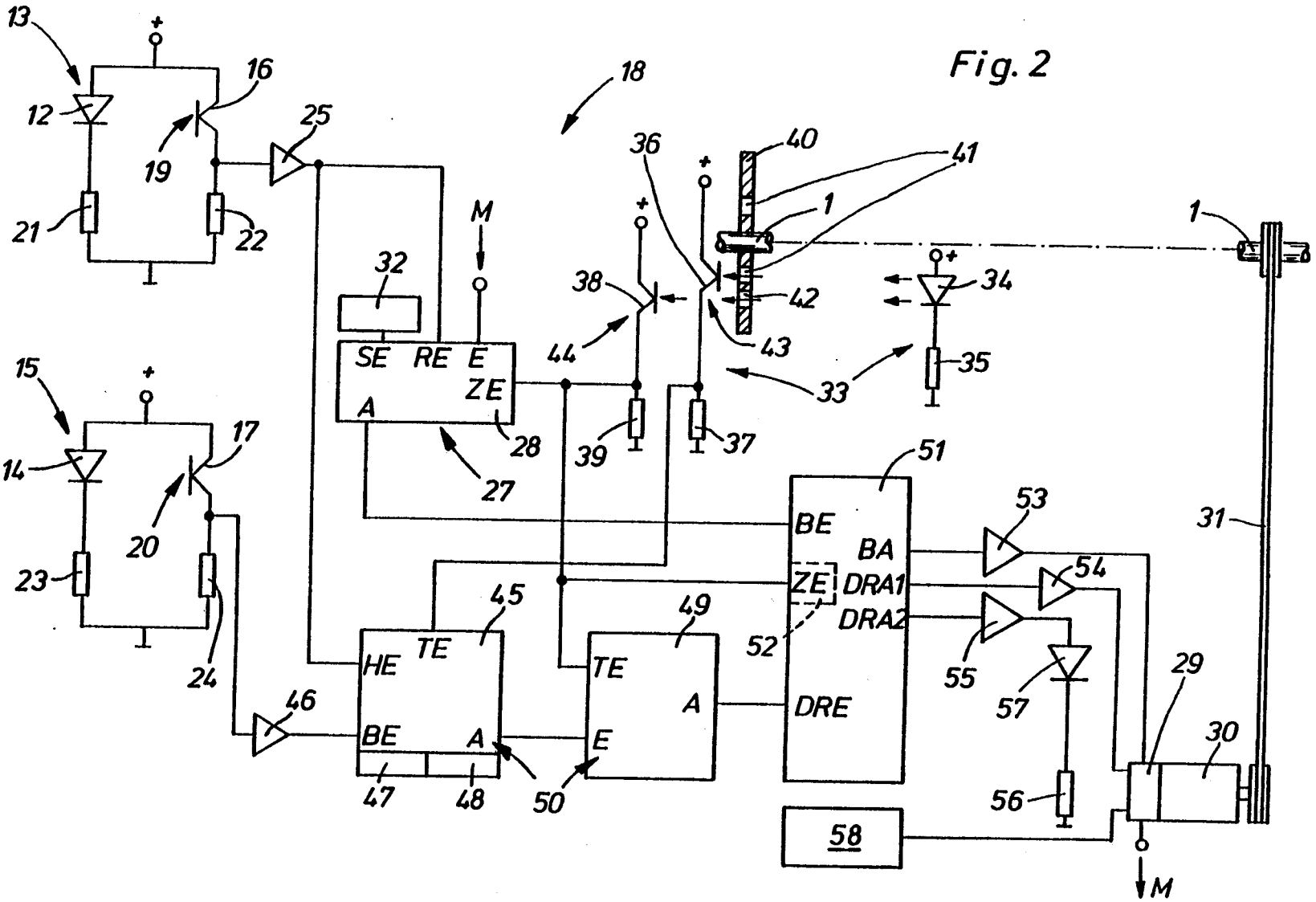
FIG. 2 is a schematic circuit diagram showing a control device according to the invention.

In a simplified circuit diagram, FIG. 2 shows a control device 18, to which the respective emitters of the two photodetectors 16 and 17, which are designed as phototransistors and of which the first photodetector 16 will hereinafter be called the main sensor 19 and of which the second photodetector 17 will be called reference sensor 20, are connected.

Current flows to ground from the positive pole of a stabilized power source via the photodiode 12 and a resistor 21 or via the main sensor 19 and a resistor 22. Current also flows to ground from the positive pole of a power source via the photodiode 14 and a resistor 23 or via the reference sensor 20 and a resistor 24.

An amplifier 25, which is connected to a resetting input RE of a counter 28 acting as a thread break detector 27, is connected to the emitter of the main sensor 19. The counter 28 also has an input E, to which a signal M can be sent at the beginning of the sewing process during a predeterminable number of stitch formation cycles from a control unit 29 of the drive motor 30 of the sewing machine, which motor 30 drives the main shaft 1 via a V-belt 31.

To set the counter 28, a signal indicating the counter end value can be sent to it via a setting input SE. The counter end value can be preselected on a setting element 32, to which the setting input SE is connected.

The control device 18 is provided with a position transducer 33. This has a photodiode 34, which is connected to the positive pole of a stabilized power source and which is grounded via a resistor 35, a photodetector 36, which is designed as a phototransistor, is connected to the positive pole, and is grounded via a resistor 37, and a second photodetector 38 designed as a phototransistor, which is also connected to the positive pole and is grounded via a resistor 39. A disk 40, which has a plurality of slots 41 spaced at equal distances from one another in the path of light between the photodiode 34 and the first photodetector 36, and a single opening 42 in the path of light between the photodiode 34 and the second photodetector 38, is attached to the main shaft 1 between the photodiode 34 and the photodetectors 36 and 38. The part of the position transducer 33 provided with the photodetector 36 forms an incremental transducer 43, while the part containing the photodetector acts as a stitch impulse generator 44.

The stitch impulse generator 44 is connected to the counting input ZE of the counter 28, while the incremental transducer 43 is connected to a timing input TE of a comparison device 45. The comparison device 45 has a main signal input HE, to which the main sensor 19 is connected via the amplifier 25, and a reference signal input BE, to which the reference sensor 20 is connected via an amplifier 46, and the comparison device 45 is provided with a memory 47 and a timing generator 48.

The output A of the comparison device 45 is connected through a bobbin jitter filter 49, to which the impulses of the stitch impulse generator 44 are sent via a timing input TE, and, together with the bobbin jitter filter 49, it forms a direction of rotation detector 50.

The output A of the bobbin jitter filter 49 is connected to the direction of rotation signal input DRE of an error decoder 51, which may be formed, like the comparison device 45 and the bobbin jitter filter 49, by a programmable logical unit (PAL unit). The error decoder 51 also has a break signal input BE, to which the output A of the counter 28 is connected, and an internal counter 52, to whose input ZE the stitch impulse generator 44 is connected.

The error decoder 51 is provided with three outputs, of which the break signal output BA is connected, via an amplifier 53, and of which a first direction of rotation signal output DRA1 is connected, via an amplifier 54, to an input each of the control unit 29 of the drive motor 30. A second direction of rotation signal output DRA2 is connected to a grounded display element 57.

The first arrangement operates as follows:

During the sewing process, the light beams of the photodiodes 12 and 14 fall on the marking 10 through the opening 11 of the upper bobbin case 7, are reflected from the marking, and, after re-exiting from the opening 11, they are sent as signals to the main sensor 19 as well as to the reference sensor 20. These signals are received by the main sensor as a first signal pattern, hereinafter called the main signal pattern, and by the reference sensor 20 as a second signal pattern (reference signal pattern), which is phase-shifted compared with the main signal pattern because of the reference sensor 20 being arranged offset by a predeterminable angle of rotation in relation to the main sensor 19. If the main sensor 19 is arranged in front of the reference sensor 20 in the direction of rotation of the bobbin 6, the main signal pattern X1 leads the reference signal pattern X2 by the amount of the phase shift V1, as is shown in FIG. 4.

In the case of a the marking 10 with fields 9 of different reflectivity according to FIG. 3, the signal patterns X1 and X2 are repeated as long as the bobbin 6 maintains its direction of rotation without change, as soon as two adjacent fields 9 have passed through the monitoring zone I of the main sensor 19 or the monitoring zone II of the reference sensor 20. In the embodiment shown, this happens after a 90° revolution of the bobbin. FIG. 3 shows three bobbin positions which are passed through in the course of rotation by a rotation angle corresponding to two the fields 9, and in which another signal appears at least during one of the two signal patterns X1, X2.

Figures 4, 5:
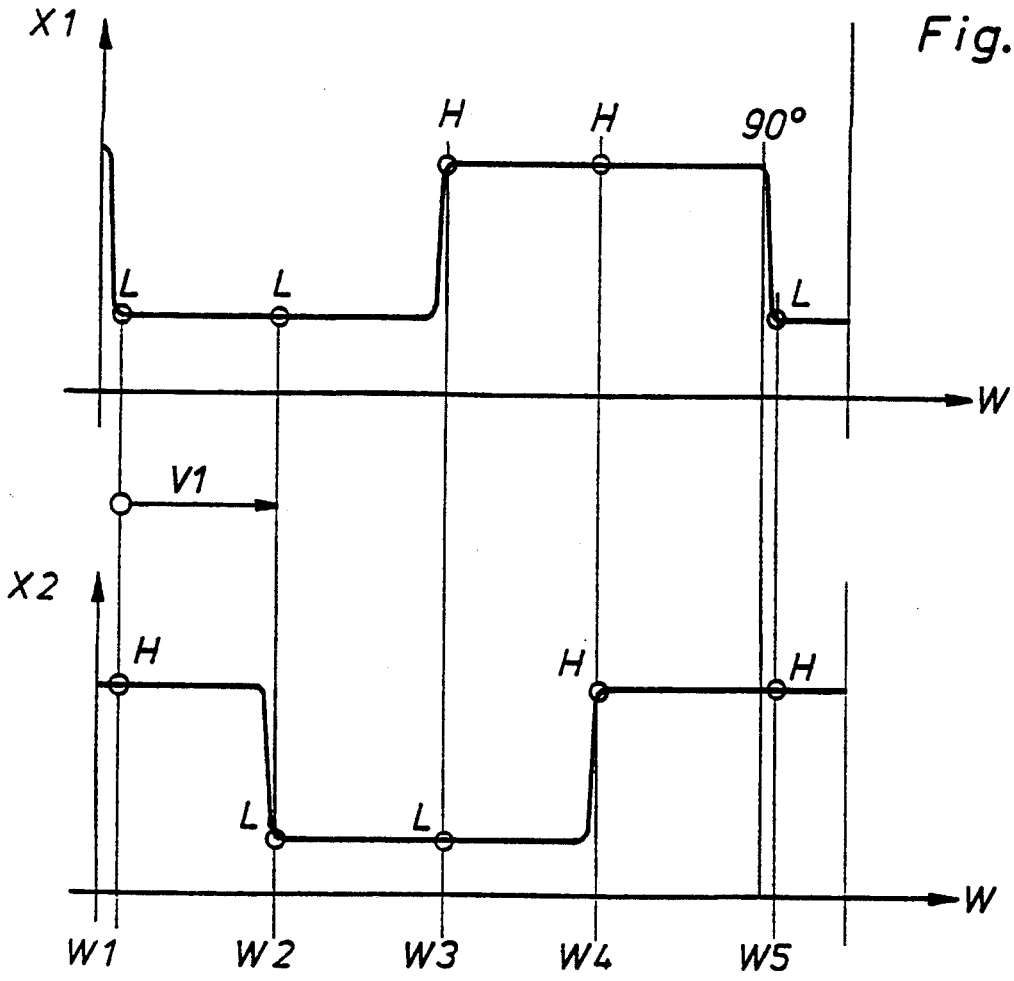
FIG. 4 is a graph with diagrams representing the signal patterns obtained on the rotation positions a)–d) of the bobbin according to FIG. 3.
FIG. 5 is a diagram listing the distinctive signal points according to FIG. 4.

FIG. 4 shows the main signal pattern X1 as well as the reference signal pattern X2 over a rotation angle W of the bobbin 6. The rotation angle W1 is associated here with the bobbin position shown in FIG. 3*a*; W2 is associated with the position shown in FIG. 3*b*; W3 is associated with the position shown in FIG. 3*c*; and W4 is associated with the position shown in FIG. 3*d*. At the rotation angle W1, the main sensor 19 receives a signal of lower intensity, hereinafter called signal L while the reference sensor 20 receives a signal of higher intensity, called signal H for short. At the rotation angle W2, both sensors receive a signal L; at rotation angle W3, the main sensor 19 receives a signal H, and the reference sensor 20 receives a signal L, and both the sensors receive a signal H at the rotation angle W4. The signal pair received at the rotation angle W5 corresponds to that received at rotation angle W1. The sequence of the signal pairs is listed separately in a table in FIG. 5.

After inserting a full bobbin 6, it is set into motion by pulling off bobbin thread for one revolution before the sewing process begins. The main signal pattern received by the main sensor 19 in this process is sent to the input HE, and the reference signal pattern received by the reference sensor 20 is sent to the input BE of the comparison device 45. At the cadence predetermined by its timing generator 48, this comparison device 45 receives at its inputs HE and BE a signal pair each, which are read into the memory 47, if these signal pairs differ from the respective preceding signal pair. As a result, signal pairs whose sequence corresponds to that in FIG. 5 are listed in the memory 47.

At the beginning of the sewing process, the comparison device 45 receives—at the cadence predetermined by the incremental transducer 43 at the input TE—signals of the main signal pattern received by the main sensor 19 at its input HE, and signals of the reference signal pattern received by the reference sensor 20 at its input BE, and polls a reference signal pair from the memory 47 if the signal pair received last differs from the signal pair received next to last. The respective instantaneous actual signal pair corresponds to the associated reference signal pair as long as the direction of rotation of the bobbin 6 and consequently the phase shift V1 between the two signal patterns X1 and X2 have not changed, because if the phase shift V1 remains constant, the actual signal pairs are read at the inputs HE and BE of the comparison device 45 in the same sequence as the reference signal pairs stored in the memory 47.

Figures 6, 7:
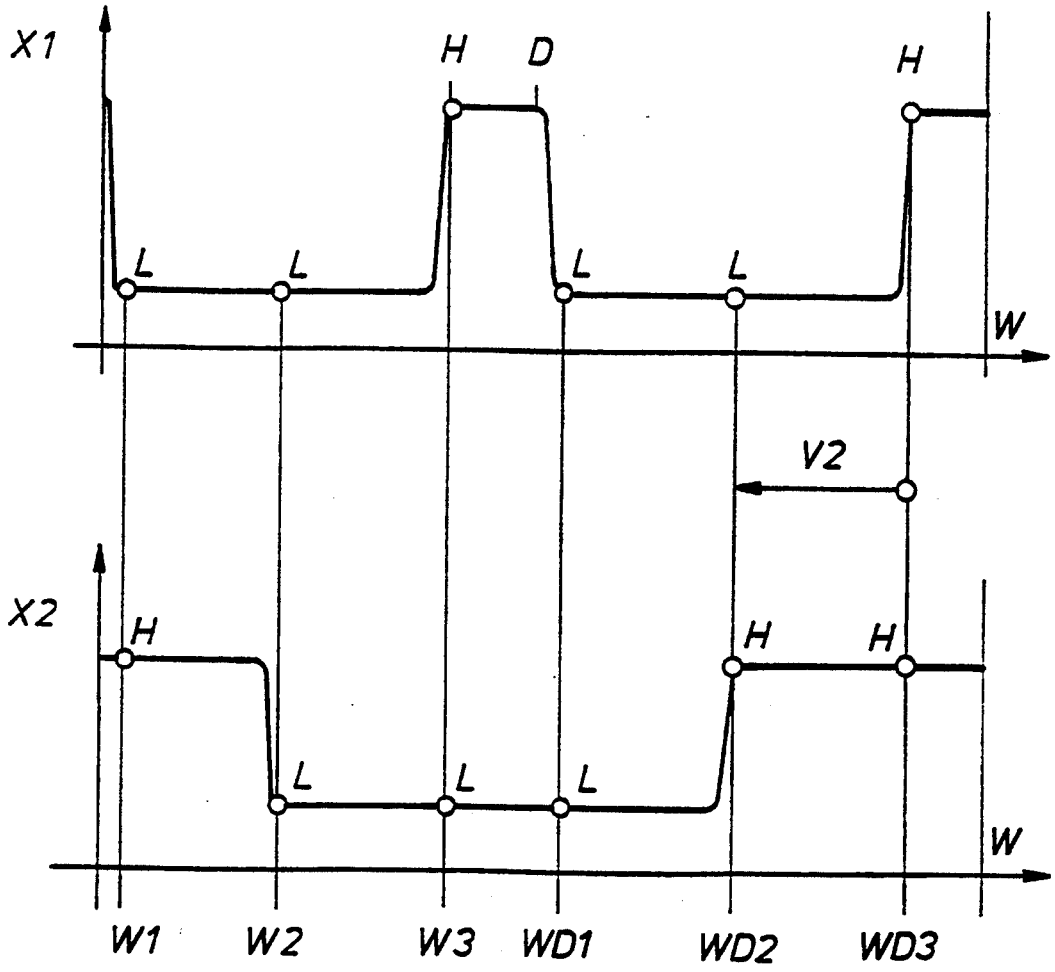
FIG. 6 is a graph showing diagrams similar to FIG. 4, but at the time of change in the direction of rotation of the bobbin.
FIG. 7 is a diagram similar to FIG. 5, but at the time of change in the direction of rotation of the bobbin.

When the direction of rotation of the bobbin 6 changes, e.g., after passage through the rotation angle W3 according to FIG. 6, the phase shift between the signal patterns X1 and X2 reverses compared with the phase shift of the signal pattern set values according to FIG. 4, and, as is shown in FIG. 6, the main signal pattern X1 now leads the reference signal pattern X2 by the phase shift V2. Therefore, the sequence of the actual signal pairs, listed in FIG. 7, which are read in at the inputs HE and BE of the comparison device 45, will deviate from the reference signal pairs according to FIG. 5.

In the case of agreement between the reference signal pairs, a signal H is sent to the bobbin jitter filter 49 from the output A of the comparison device 45. In contrast, in the absence of agreement, a signal of much lower intensity (signal L), by which the change in the direction of rotation of the bobbin 6 is indicated, is sent to the bobbin jitter filter 49.

Vibrations caused by drive on the sewing machine may cause short-term alternating forward-and-backward movements of the bobbin 6, especially if the thread tension is temporarily reduced by sewing technical processes. To avoid an error indication because of this phenomenon, which is called bobbin jitter in sewing technology, the bobbin jitter filter 49 receives a plurality of signals of the comparison device 45 in the course of a predeterminable number of stitch formation cycles indicated via the stitch impulse generator 44 before it sends a direction of rotation signal to the input DRE of the error decoder 51. This direction of rotation signal (signal H) indicates unchanged direction of rotation of the bobbin 6 if all the signals received at the input E of the bobbin jitter filter 49 indicate the direction of rotation of the bobbin 6 that is associated with the principal amount of thread or a steady change between this and the other direction of rotation. However, if a predeterminable number of consecutive signals at the input E of the bobbin jitter filter 49 consistently indicate a change in the direction of rotation, the bobbin jitter filter 49 sends a direction of rotation signal of lower intensity (signal L) from its the output A to the error decoder 51.

When the error decoder 51 receives a signal H at its the input DRE, the control unit 29 of the drive motor 30 is triggered by a signal at the output DRA1 such that this drive motor 30 is no longer able to start after stopping the sewing machine. In addition, the display element 57 is connected by a continuous signal at the output DRA2. To erase the display element 57, a signal generated by the operator is sent to the error decoder 51 in a manner not shown.

Simultaneously with the emission of the signals to the outputs DRA1 and DRA2, the counter 52 of the error decoder 51 receives the signals of the stitch impulse generator 44 and, after a predeterminable counter end value is reached, it causes the error decoder 51 to send from its the output DRA1 a second signal to the control unit 29 of the drive motor 30, by which second signal the drive motor 30 is stopped. The counter end value is selected such that the residual amount of thread will be consumed nearly completely by the time this end value is reached.

The counter 28, connected to the input BE of the error decoder 51, receives impulses of the stitch impulse generator 44 at its the counting input ZE and adds them up. At each change of the signal received by the main sensor 19, the counter 28 is reset to its initial value via its the input RE. This resetting takes place as long as the bobbin 6 is being driven such that bobbin thread is pulled off trouble-free, before the counter 28 has counted up to the counter end value that is preselectable via the setting member 32. The counter end value is advantageously selected to be such that it will not be reached during a short-term slack thread, which may occur during the sewing process and causes the bobbin to temporarily stop. However, in the case of prolonged stoppage of the bobbin as a consequence of a thread break, the count will reach the counter end value, after which a signal H will be sent to the input BE of the error decoder 51 from the output of the counter 28, instead of the signal L present there up to now. As a result, a signal is caused to be sent from the output BA of the error decoder 51 to the control unit 29 of the drive motor 30, as a result of which the drive motor 30 will be stopped.

At the time of restart of the drive motor 30 after elimination of the thread disturbance, the signal M is sent to the input E of the counter 28 from the output of the control unit 29 for a predeterminable number of stitch formation cycles to cause the switching function of the counter 28 to be temporarily suspended. This measure is useful to avoid an error indication that is caused by a machine function that precedes the sewing process and causes a prolonged slack thread, such as thread cutting.

The sewing machine is provided with an auxiliary device 58, which makes it possible to carry out the process known from U.S. Pat. No. 5,078,068 and which is connected to the control unit 29 of the positioning motor 30. The auxiliary device 58, which can be put into operation by a signal of the error decoder 51 or by a signal generated by the operator, makes it possible, if the drive motor 30 is stopped in mid seam, to continue the seam formation after elimination of the thread disturbance such that the course of the needle thread on the fabric being sewn will be prevented from being interrupted.

Figure 8:
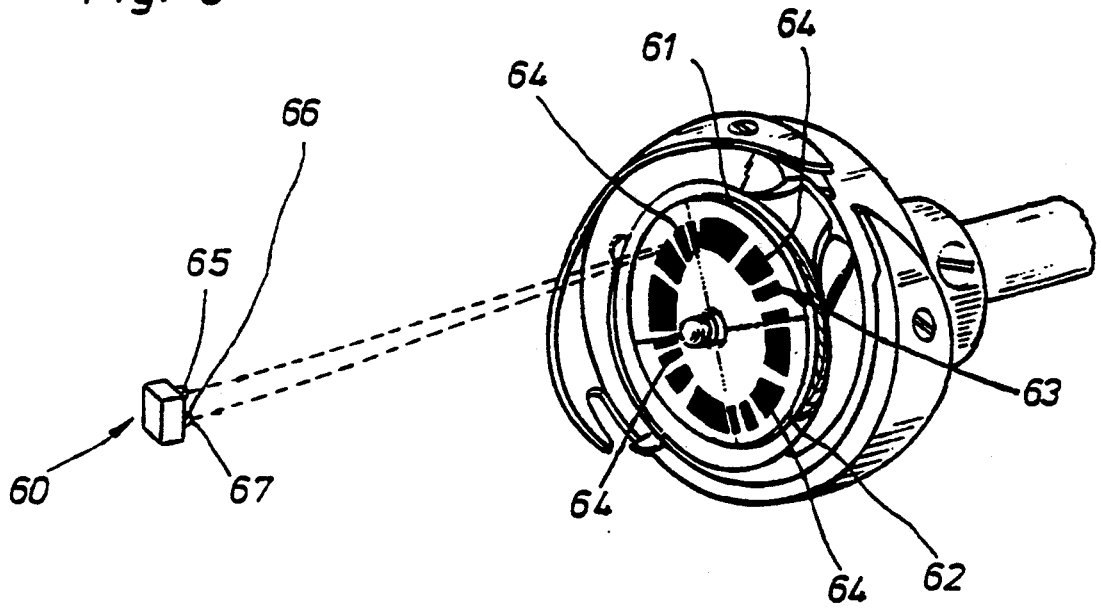
FIG. 8 is a perspective view with schematically shown sensor, similar to FIG. 1, but with only one sensor device and with another marking on the bobbin.

In a second embodiment shown in FIG. 8, a binary coding 63, which is subdivided into four uniform code segments 64 each covering an angle range of 90°, is provided on the outside of the flange 61 of a bobbin 62 facing a sensor device 60. The light beams of a photodiode 65 of the sensor device 60 reflected, after falling on the binary coding 63, to a sensor 67 of the sensor device 60, which the sensor 67 is formed by a photodetector 66.

Figure 9:
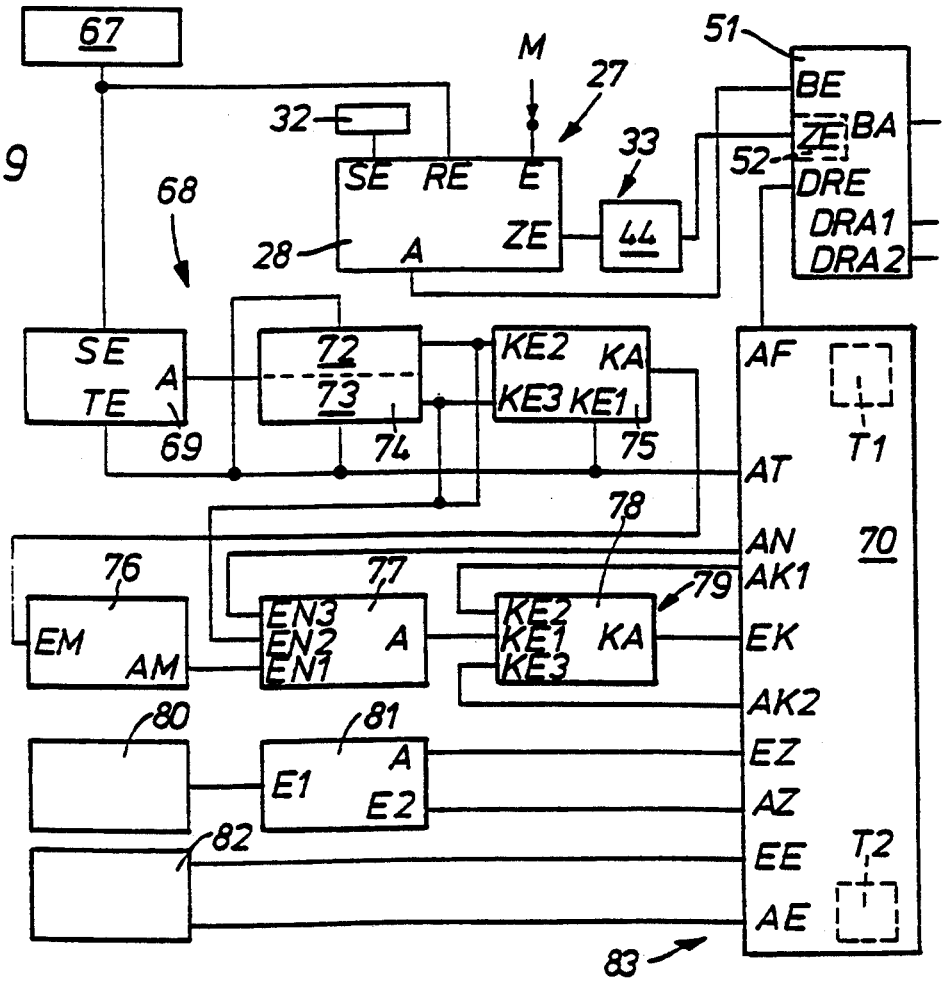
FIG. 9 is a schematic circuit diagram showing a second control device.

In a simplified circuit diagram, FIG. 9 shows a control device 68. The sensor 67 is represented only schematically because its design is the same as that of the main sensor 19 of the sensor device 13 according to the first embodiment.

The sensor 67 is connected to a signal input SE of an analog-digital converter 69 and to the resetting input RE of the counter 28, which serves to add up the stitch formation cycles indicated by the schematically represented stitch impulse generator 44 of the position transducer 33.

The A/D converter 69 is provided with a the timing input TE, which is connected to an output AT of a control element 70 which is designed as a microprocessor and has a timing generator T1 for presetting the cadence to be sent to the output AT. The output AT is also connected to a register 72, 73 each of a two-register memory 74, which will hereinafter be called a ZR register, and to an input KE1 of an autocorrelator 75.

The output A of the A/D converter 69 is connected via the ZR memory 74 to an input KE2 and KE3 each of the autocorrelator 75, whose output KA is connected to an input EM of an averager 76. The output AM of the averager 76 is connected to an input EN1 of a standardizer 77, to the second input EN2 of which the registers 72 and 73 of the ZR memory 74 are connected, and to the third input EN3 of which an output AN of the control element 70 is connected. The output A of the standardizer 77 is connected to an input KE1 of a cross correlator 78, to the second input KE2 of which an output AK1, and to the third input KE3 of which an output AK2 of the control element 70 are connected. The output KA of the cross correlator 78 is connected to an input EK of the control element 70. The cross correlator 78 acts as a comparison device 79.

A control panel 80 is connected to an input EZ as well as to an output AZ of the control element 70 via a buffer memory 81. A memory 82, in which a program for presetting the sequence of steps to be executed by the control element 70 is stored, is connected to an input EE as well as to an output AE of the control element 70. The steps are polled from the memory 82 by addressing at the output AE of the control element 70 and read in at the input EE at the cadence preset by a timing generator T2 of the control element 70.

A direction of rotation detector 83, which is connected to the input DRE of the error decoder 51 via an output AF of the control element 70, is formed by the elements 69 through 82.

As was described in the first embodiment, the output A of the counter 28 of the thread break detector 27 is connected to the input BE of the error decoder 51. The connections at the outputs of the error decoder 51 correspond to those of the first embodiment.

The second arrangement operates as follows:

Due to rotation of the bobbin during the sewing process, the binary coding 63 is received as a signal pattern by the sensor 67, sent as a pseudorandom signal pattern, hereinafter called PZF for short, to the A/D converter 69, and is transformed, in terms of its length, into PZF sections that depend on the cadence present at the output AT of the control element 70. Since the PZF sections are formed at a constant cadence, whereas PZF periods, each of which corresponds to the passage of a the code segment 64 of the binary coding 63 through the action zone of the sensor 67, are formed depending on the bobbin's speed of rotation, which is influenced by such parameters as, e.g., the stitch formation frequency, the stitch length, and the filling ratio of the bobbin 62, a PZF period will correspond to a PZF section only accidentally.

The respective actual PZF section is read into one of the registers 72 or 73 of the ZR memory 74. As soon as the register 72, 73 is filled with writing, reading is switched over to the respective other register. Loss of data is thus avoided.

The autocorrelator 75 polls, at each timing signal that is present at its the input KE1, the PZF section stored from the register 72 or 73, at which the read-in process is concluded, copies this section, and shifts the copy in relation to the original, until the agreement with the original reaches a maximum. The period P1 of one PZF period in the autocorrelated PZF section is obtained from the distance between this maximum and the next maximum obtained by further shifting of the copy in relation to the original.

The following equation is used to calculate the autocorrelation function:

$$ACF(n) = \frac{\sum_{i=0}^{k-1} (PZF_i - M1)*(PZF_{(i+n)} - MK)}{\left[\sum_{i=0}^{k-1} (PZF_i - M1)^2 * \sum_{i=0}^{k-1} (PZF_{(i+n)} - MK)_2\right]^{\frac{1}{2}}}$$

ACF(n)=autocorrelation coefficient, range of values (−1, . . . +1)

$PZF_i$=PZF values of the current PZF section

M1=mean value of the PZF values of the current PZF section

MK=mean value of the PZF values of the PZF section copied, which [PZF values] are autocorrelated with the current PZF section, k=limit of the range of shifting n=shift parameter.

The ACF coefficient is an indicator of the agreement of the original PZF section with the copy. Now, ACF(n)=+1 highest possible similarity ACF(n)=0 no similarity ACF(n)=−1 highest possible inverse similarity.

To prevent short-term changes in the speed of rotation of the bobbin 62 from influencing the period duration P1 as much as possible, a new period duration mean value PM2 is calculated by the averager 76 from the period duration P1 determined last and a mean value PM1 formed from preceding period durations, and is sent to the input EN1 of the standardizer 77. By forming a ratio, the conversion factor, which must be incorporated in the current PZF section polled from one of the registers 72, 73 of the ZR memory 74, is determined from the period duration mean value PM2 and a period duration reference value PV, which can be sent to the input EN3 of the standardizer 77 from the output AN of the control element 70. The period duration reference value PV sent to the output AN of the control element 70 is associated with a reference PZF period, which corresponds to the binary coding 63 on the flange 61 of the bobbin 62, and which is entered into the buffer memory 81 via the control panel 80. The period duration reference valve PV is read in at the input EZ of the control element 70 after corresponding addressing of the buffer memory 81.

The PZF section thus standardized is sent to the input KE1 of the cross correlator 78. At the same time, the control element 70 polls from the buffer memory 81 the following reference PZF period, hereinafter called the original reference period, and forms a mirror-inverted reference period from it. The control element 70 sends the original reference period from its the output AK1 to the input KE2 of the cross correlator 78, and the mirror-inverted reference period from its the output AK2 to the input KE3 of the cross correlator 78.

The standardized current PZF section is shifted by the cross correlator 78 both relative to the original reference period and relative to the mirror-inverted reference period until the agreement with one of the reference periods reaches a maximum. If this maximum appears with the original reference period, it can be recognized from this that the sequence of the signals in the current PZF period is associated with the direction of rotation of the bobbin 62 at which the principal amount of thread is wound off. In contrast, a maximum appeared during the comparison with the mirror-inverted reference period is indicative of a change in the direction of rotation of the bobbin 62 and consequently of the consumption of the residual amount of thread. In this direction of rotation of the bobbin 62, the binary coding 63 provided on the flange 61 is received by the sensor 67 in opposite sequence.

The following equation is used to calculate the cross-correlation function:

$$KKF(n) = \frac{\sum_{i=0}^{k-1} (PZFN_i - M1)*(VPZF_{(i+n)} - M2)}{\left[\sum_{i=0}^{k-1} (PZFN_i - M1)^2 * \sum_{i=0}^{k-1} (VPZF_{(i+n)} - M2)_2\right]^{\frac{1}{2}}}$$

KKF(n)=cross correlation coefficient, range of values (−1, . . . +1)

PZFNi=PZF values of the standardized current PZF section

M1=mean value of the PZF values of the standardized current PZF section

M2=mean value of the original and mirror-inverted reference periods k=limit of the range of shifting n=shift parameter.

The KKF coefficient is an indicator of the similarity of the functions compared. Now, KKF(n)=+1 highest possible similarity KKF(n)=0 no similarity KKF(n)=−1 highest possible inverse similarity.

If a KKF coefficient, which is close to the value of +1 or reaches this value, so that the change in the direction of rotation of the bobbin 62 is recognized, is formed by the cross correlation of the standardized current PZF section with the mirror-inverted reference period, the control element 70 sends from its output AF a signal L, instead of the signal H that was hitherto present there, to the input DRE of the error decoder 51. The control function subsequently triggered by this corresponds to that triggered in the first embodiment in the case of recognition of a change in the direction of rotation of the bobbin 6.

Figure 10:
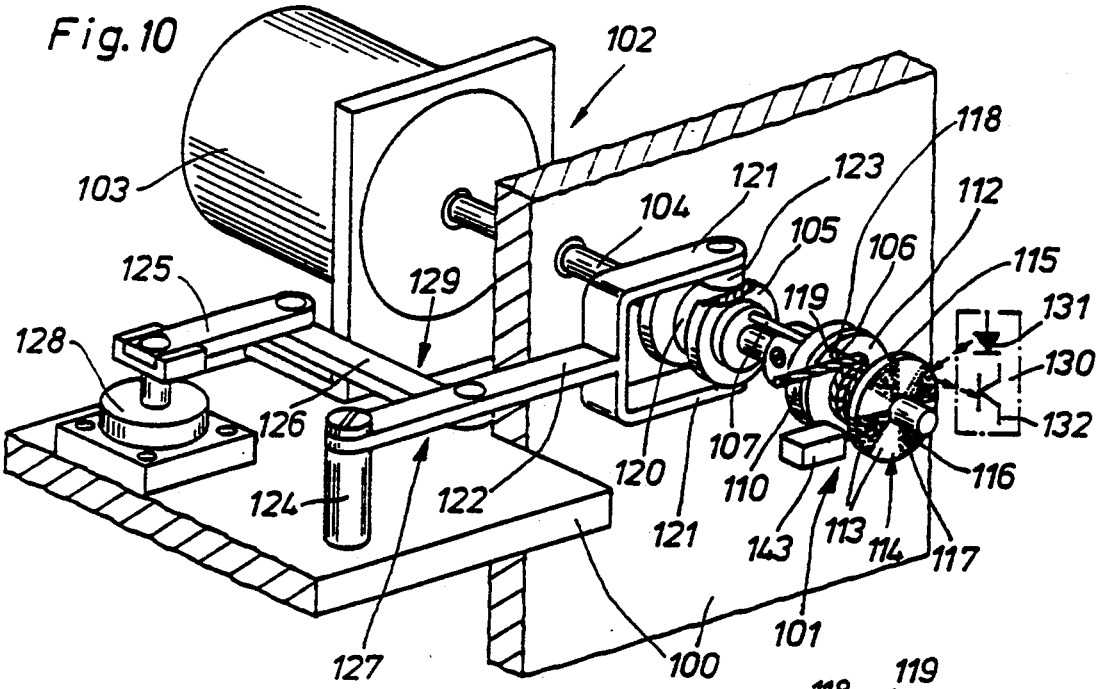
FIG. 10 is a perspective view showing a device for winding up thread on the bobbin according to the invention.
Figure 11:
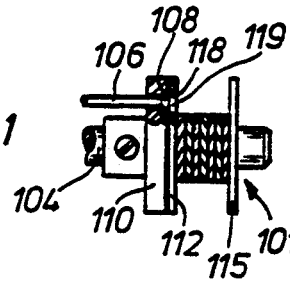
FIG. 11 is a side view showing a position of a deflecting member for the bobbin thread prior to a change in the direction of rotation of the bobbin winder shaft.
Figure 12:
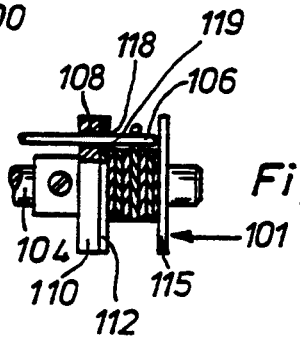
FIG. 12 is a side view showing the position of the deflecting member immediately after the change in the direction of rotation.

According to FIG. 10, a device for winding thread on a bobbin 101 is fastened to the housing 10(3 of the sewing machine. This device, which will hereinafter be called a winding device 102, has a rotary drive 103 with a bobbin winder shaft 104, on which a sliding sleeve 105 is nonrotatably arranged. A deflecting member 106 for the bobbin thread extending in parallel to the bobbin winder shaft 104 is attached to the sliding sleeve 105. The deflecting member 106, designed as a pin 107, is guided in a recess 108 (FIG. 11) of a stop 110, which is attached to the bobbin winder shaft 104 and serves as an abutment for the bobbin 101 that can be placed on the bobbin winder shaft 104, and is displaceable between a resting position, in which it is disengaged from the bobbin thread (FIG. 11), and a deflecting position, in which it extends into the feed path of the bobbin thread (FIG. 12). The bobbin 101, whose flange facing the stop 110 will hereinafter be designated with the reference numeral 112, and whose other flange, provided on its outside with a marking 114 formed by light-and- dark fields 113, will be designated with the reference numeral 115, is secured against rotary movement in relation to the bobbin winder shaft 104 by a bale spring 116, which is fastened to the bobbin winder shaft 104 and extends into the carrier slot 117 of the bobbin flange 115. In the position of the bobbin 101 on the bobbin winder shaft 104, which is preset as a result, the carrier slot 119, which is provided on the other bobbin flange 112 and serves as an opening 118 for the passage of the deflecting member 106, is directed toward the deflecting member 106.

The sliding sleeve 105 is provided with a circular guide groove 120 for pins 123 provided at the fork-shaped ends 121 of a rocker 122. The rocker 122, which is pivotably mounted around a fixed bearing, forms, together with a second rocker 125 that extends in parallel and with a connection rod 126, a connecting rod parallelogram 127. This in turn forms, together with an actuating drive 128, which is nonrotatably connected to the rocker 125, an adjusting device 129 for the deflecting member 106.

The marking 114 on the bobbin flange 115 is monitored by a sensor device 130 represented only symbolically by light emitted by a photodiode 131 being sent, after reflection from the marking 114, to a photodetector 132 designed as a phototransistor.

Figure 13:
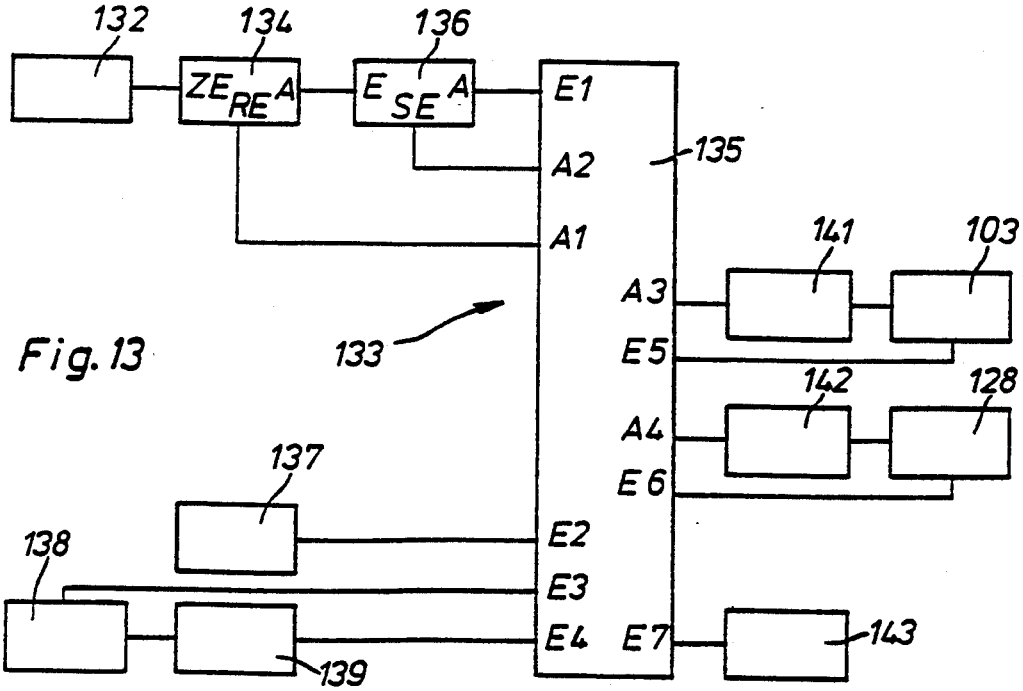
FIG. 13 is a schematic circuit diagram showing a control device for the device for winding up the thread.

In a simplified circuit diagram, FIG. 13 shows the elements of a control device 133 that are necessary for the function of the winding device 102. The emitter of the photodetector 132 is connected to the counting input ZE of a counting device 134 which counting device 134 also has a resetting input RE connected to an output A1 of a control element 135 formed by a microcomputer. The output A of the counting device 134 is connected to an input E of a comparator 136, whose setting input SE is connected to an output A2 of the control element 135. The output A of the comparator 136 is connected to the input E1 of the control element 135.

A program memory 137, in which the control program for the control element 135 is stored, is connected to an input E2 of the control element 135. An input E3 of the control element 135 is connected to a control panel 138 that is also connected via an input block 139 to an input E4 of the control element 135. An output A3 of the control element 135 is connected to the rotary drive 103 via a power circuit 141, and an output A4 is connected to the actuating drive 128 via a power circuit 142. The rotating drive 103 in turn is connected to an input E5, and the actuating drive 128 is connected to an input E6 of the control element 135.

A limit switch 143, represented only symbolically, which is depressed when a predetermined bobbin filling is reached, is connected to an input E7 of the control element 135.

The winding device 102 operates as follows:

After an empty bobbin 101 is placed on the bobbin winder shaft 104, a signal is sent to the input E3 of the control element 135 via the control panel 138, after which the control element 135 sends a signal from its output A3 to the power circuit 141 to turn on the rotating drive 103 and consequently to drive the bobbin winder shaft 104.

The light beams of the photodiode 131 fall on the light-and-dark fields of the marking 114 and are received by the photodetector 132 as signals of alternating intensity because of the alternating reflection behavior during the rotation of the bobbin 101. Since the number of signals per revolution of the bobbin 101 is preset by the number of the light-and-dark fields 113 on the bobbin flange 115, the associated number of revolutions of the bobbin 101 can be determined from the number of these signals. The signals received by the photodetector 132 are sent to the counting device 134, which sends from its output A the respective last count value to the input E of the comparator 136. The comparator compares this count value with a preset value which can be set on the control panel 138, can be read by the control element 135 at its input E4 after buffer storage in the input block 139 at the beginning of the winding process, and can be sent, after being sent to the output A2 of the control element 135, to the setting input SE of the comparator 136. As long as the count value fails to agree with the preset value, the comparator 136 suppresses the sending of a signal at its output A. However, when the control element 135 receives a signal from the comparator 136 at its input E1, a predetermined number of thread turns forming the residual amount of thread is present on the bobbin 101. The control element 135 then sends from its output A3 a signal to stop the rotating drive 103 and, as soon as its input E5 receives a signal indicating stoppage of the rotating drive 103, it sends a signal for turning on the actuating drive 128 from its output A4.

Put into motion by the actuating drive 128, the rocker 125 is moved by a predeterminable pivoting angle in the direction of the bobbin 101 and thereby deflects the rocker 122 around the fixed bearing 124 via the connecting rod 126 for a pivoting movement. The rocker 122, which acts on the sliding sleeve 105 via the connection formed by the pin 123 and the guide groove 120, thereby displaces the sliding sleeve 105 in the direction of the bobbin 101 into the position according to FIG. 10. The deflecting member 106 is shifted by this movement from its resting position (FIG. 11) into its deflecting position (FIG. 12). As soon as the input E6 of the control element 135 receives a signal indicating that the deflecting position has been reached from the actuating drive 128, the control element 135 sends a signal to its output A3, by which the rotating drive 103 is put into operation for a movement opposite the previous direction of rotation, as a result of which the direction of winding of the thread turns will be reversed. Loosening or winding off of at least part of the thread turns forming the residual amount of thread because of the change in the direction of rotation is prevented by the deflecting member 106, toward which the bobbin thread is pulled at the beginning of rotation of the bobbin in the new direction of rotation. The deflecting member 106 also ensures that even the first thread turn wound up in the new direction of rotation will be wound tautly.

Together with the emission of signal from its the output A3 for turning on the rotating drive 103 in the new direction of rotation, the control element 135 also sends a signal from its the output A1 to the resetting input RE of the counting device 134, as a result of which the counting device 134 will be reset to its initial value. The counting device 134 again adds up the signals in the new direction of rotation of the bobbin 101 until a second preset value, which can also be entered on the control panel 138, can be read into the control element 135 via the input block 139, and is sent to the setting input SE of the comparator 136, is reached. The emission of a signal from the output A of the comparator 136 when the second preset value is reached causes a signal to be sent from the output A4 of the control element 135 to the actuating drive 128, as a result of which this returns into its starting position, causing the deflecting member 106 to return into the resting position. The second preset value is selected to be such that a sufficient number of thread turns will be wound up in the new direction of rotation in order to make it possible to return the deflecting member 106 into its resting position without disadvantageously influencing thereby the further winding process.

When it is indicated—due to a signal being received at the input E6 of the control element 135—that the actuating drive 128 has reached its starting position, the counting device 134 is reset to its initial value and turns off until the beginning of the next winding process by sending another signal from the output A1.

The winding process is continued until a signal sent from the limit switch 143 to the input E7 of the control element 135 indicates that the bobbin 101 is full. The control element 135 then sends a signal from its the output A3 to turn off the rotating drive 103.

While specific embodiments of the invention have been shown and described in detail to illustrate the application of the principles of the invention, it will be understood that the invention may be embodied otherwise without departing from such principles.

What is claimed is:

1. A device for winding up thread on a bobbin for providing the bobbin with thread having turns of a predeterminable residual amount of thread wound in a direction opposite a direction of winding of a principle amount of thread comprising: a winder drive and a winder shaft for rotating the bobbin for winding of thread; counting means for counting revolutions of the bobbin winder shaft; a deflecting member movable from a resting position located outside a path of feed of thread to a deflecting position located within a path of feed of thread; an adjusting device connected to said deflecting member for moving said deflecting member between said resting position and said deflecting position and control means for activating said deflecting member based on a predeterminable filling ratio of said residual amount of thread to said principle amount of thread, an actual filling amount of thread being determined based on revolutions counted by said counting means.

2. Device in accordance with claim 1, wherein said control means controls a number of revolutions to be performed by the bobbin winder shaft between the change in the direction of rotation of the bobbin winder shaft and the return movement of the deflecting member into its resting position based on a set end value of the counting device.

3. Device in accordance with claim 1, characterized in that the deflecting member can be moved in parallel to a central axis of the bobbin and can be shifted into the bobbin through an opening provided in one of the two bobbin flanges.

4. Device in accordance with claim 3, wherein said opening is formed by a carrier slot present in the bobbin flange.

* * * * *